US005687595A

United States Patent [19]

Noe et al.

[11] Patent Number: 5,687,595

[45] Date of Patent: Nov. 18, 1997

[54] METHOD OF AND APPARATUS FOR CORRECTING CURVATURE OF ROLLED METAL STRIP

[75] Inventors: Oskar Noe; Rolf Noe; Andreas Noe, all of Mülheim, Germany

[73] Assignee: BWG Bergwerk- und Walzwerk-Maschinenbau GmbH, Duisburg, Germany

[21] Appl. No.: 592,720

[22] Filed: Jan. 24, 1996

[30] Foreign Application Priority Data

Jun. 3, 1995 [DE] Germany ..... 195 20 541.3

[51] Int. Cl.[6] ..... B21D 1/06

[52] U.S. Cl. ..... 72/8.3; 72/11.1; 72/164; 72/205; 72/161

[58] Field of Search ..... 72/164, 161, 165, 72/205, 11.1, 8.3

[56] References Cited

U.S. PATENT DOCUMENTS

| | | | |
|---|---|---|---|
| 3,344,637 | 10/1967 | Polakowski | 72/164 |
| 3,475,935 | 11/1969 | Kajiwara | 72/205 |
| 3,839,888 | 10/1974 | Greenberger | 72/205 |
| 4,316,376 | 2/1982 | Masui | 72/164 |
| 4,794,773 | 1/1989 | Bradlee | 72/8.3 |

FOREIGN PATENT DOCUMENTS

| | | | |
|---|---|---|---|
| 19230 | 11/1982 | Japan | 72/164 |
| 205820 | 8/1989 | Japan | 72/164 |
| 47418 | 2/1994 | Japan | 72/205 |

*Primary Examiner*—Daniel C. Crane
*Attorney, Agent, or Firm*—Herbert Dubno

[57] ABSTRACT

Downstream of an uncoiler, a stretch-bend leveler is provided in a strip line to correct curvature in the strip plane. One or more rollers of the stretch-bend leveler are swingable about a horizontal or vertical axis at the end of the roller in response to a measurement of the longitudinal edge arcs of the strip to effect correction.

9 Claims, 5 Drawing Sheets

METHOD OF AND APPARATUS FOR CORRECTING CURVATURE OF ROLLED METAL STRIP

FIELD OF THE INVENTION

The present invention relates to a method of and to an apparatus for correcting curvature in rolled metal strip and, more particularly, to the correction of curvature of rolled metal strip in a strip plane resulting in deviation of longitudinal edges of the strip from linearity. In particular, the invention relates to metal strip with a strip thickness of 0.5 mm to 2.0 mm whose strip edges deviate from straight lines in the longitudinal directions of the edges by horizontal bends and in which the metal strip is subjected to stretch-bend leveling by means of a roller leveler.

BACKGROUND OF THE INVENTION

Practically all rolled metal strip has longitudinal edges which deviate from straight lines. Most commonly the deviation is in the form of horizontal arcs with radii of several hundred or thousand meters. As a result, the outer band edge is longer than an inner band edge.

According to German Industrial Standard DIN 1016, for strip widths of 1600 mm to 2200 mm, the deviation from a straight line over a strip length of 5 meters should only amount to 25 mm. This corresponds to a deviation over one meter of strip length of 5 mm from a straight line. With strip lengths of 500 or 1000 meters, under these conditions, deviations from a straight line of 2.5 m or 5 m can be expected.

Such metal strip travels in strip treatment lines, for example, pickling lines, galvanization or zinc coating lines and combinations thereof, and frequently cannot be properly guided by control rollers so that the edges tend to engage parts of the structure of the pickling apparatus, the zinc coating apparatus or other units.

Indeed, the thinner the metal strip the more difficult is the control of the path thereof. Strip tension tends to be concentrated on the shorter strip side which is correspondingly stiff while the longer strip side is largely free from tension and tends to hang down or sag.

Furthermore, the metal strip does not have a constant bend radius and there are sections which are rolled under tension which may have a smaller radius than other sections which are rolled with reduced tension. As a rule it is not possible to provide a constant correction factor by which the feed of the strip can be corrected.

Trimming of such metal strip which has one longitudinal edge longer than the other, also poses a problem because the longer edge tends to be compressed resulting in folds and limiting the ability to trim to at most several meters in length. The result is interruption of the processing of strip since the strip must frequently be brought to standstill for correction. The consequence is not only a loss of production and increased danger, especially because side trimming must frequently be limited to only 5–8 millimeters per side.

OBJECTS OF THE INVENTION

It is, therefore, the principal object of the present invention to provide a method of correcting curvature of the metal strip in a horizontal plane, i.e. in the strip plane which can be carried out continuously and simply and which allows the strip to feed in a linear manner through a strip processing line.

It is also an object of this invention to provide an apparatus for eliminating the horizontal bend of metal strip, i.e. for correcting curvature of rolled metal strip in the strip plane resulting in deviation of longitudinal edges of the strip from linearity.

Still another object of the invention is to provide a method of an apparatus for correction of the curvature of metal strip in the strip plane for strip advanced in a strip processing line whereby drawbacks of earlier systems are obviated.

SUMMARY OF THE INVENTION

These objects and others which will become apparent hereinafter are attained in accordance with the invention in a method whereby the travel of the longitudinal edges at the metal strip is measured continuously on both longitudinal sides of the strip at a predetermined distance from a stretch-bend or roller leveler and upon detection of a horizontal deviation, for correction of the linear travel of the longitudinal edges, at least one and usually a plurality of the rollers of the roller leveler are swung by an amount sufficient to correct the deviation and determined by the deviation at the short strip side in horizontal planes and or vertical planes.

More particularly, the method of correcting curvature of the rolled metal strip in a strip plane resulting in deviation of longitudinal edges of the strip from linearity can comprise the steps of:

(a) passing the metal strip through a stretch-bend leveler having a plurality of rollers alternately engaging the metal strip from opposite sides thereof;

(b) downstream of the stretch-bend leveler continuously measuring a shape of the longitudinal edges to detect a deviation corresponding to horizontal curving of the strip in the strip plane; and (c) pivoting at least one of the rollers in a plane thereof in response to the deviation and in relation to the deviation to deflect the strip at the shorter edge, thereby selectively lengthening the shorter edge to correct the horizontal curving and straighten the strip.

The pivoting of the pivotal rollers can be carried out in the horizontal plane and/or a vertical plane thereof.

The "rolled metal strip" to which the invention can be applied can be both cold rolled or hot rolled metal strip and, while the invention is applicable to rolled metal strip of any kind suffering from the tendency to develop deviations from the linear at the longitudinal edges in the horizontal plane, it is particularly applicable to steel strip.

Roller or stretch-bend leveling refers to the process described, for example, at page 1096 of the "Making Shaping and Treating of Steel", U.S. Steel Company, 10th Edition, 1985, whereby, while the strip is under tension, the strip is passed alternately over and under a number of rollers which deform the strip alternately upwardly and downwardly.

The invention utilizes the fact that during the stretch bend or roller leveling, the strip is deformed in a plastic or at least semiplastic state and thus allows without difficulty a lengthening of the shorter edge of the strip by corresponding pivotal adjustment of one or more of the leveler rollers.

Surprisingly a one sided pivoting of the leveler rollers in horizontal planes with a comparatively slight inclination can bring about a sufficient length change at the shorter strip side to compensate for any greater length along the opposite longitudinal edge.

As a result of the lengthening of the shorter strip side, the horizontal bend at the longer strip edge can be fully compensated and full correction of the bending in the strip plane can be achieved. The correction can be carried out continuously and with relatively simple means.

The correction can be carried out at one or the other surface of the strip, i.e. with the upper or lower rolls of the strip leveler, or both and can be effected not only by a horizontal pivoting of one or more leveler rollers but by the pivoting of one or more leveling rollers also in vertical planes. Depending upon which side of the strip the roller is provided on, therefore, the pivoting roller can raise or lower the strip along the shorter edge. Naturally intermediate positions between vertically or horizontally swung positions can also be assumed by the leveling rollers and indeed they can be swung in planes between horizontal and vertical planes.

According to the invention, to the leveling deformation there is added a plastic deformation along the shorter edge of the metal strip while the strip is under horizontal tension to provide the requisite elongation and thus compensation for the horizontal bend at the longer longitudinal edge. The arc with which the strip engages each of the leveling rollers can be adjusted finely with the lateral swinging thereof, and indeed, even more finely than with a vertical displacement of the rollers as a whole, thereby allowing high precision compensation of the length of the strip edge. Depending upon the arc radius, i.e. the difference in lengths of the inner and outer longitudinal edges of the horizontally bent strip, the length change required can be coarsely adjusted initially and then more finely adjusted so that finally the adjustable leveller roller or the leveler rollers can be so pivoted that a sufficient lengthening of the shorter strip side can occur.

While the correction of the curvature is preferably effected immediately upon unwinding of the strip from a coil, it may be effected following the passage of the strip through a dressing stand to avoid problems with previous bending which may cause standstill of that stand and the processing line.

A dressing stand is a cold rolling stand which generally reduces the thickness of the strip by a small amount, say a maximum of 3%. A typical thickness reduction in the dressing stand is 0.5 to 1%. When thickness reductions of 0.2 to 0.3% are carried out in the dressing stand, the result is principally an improvement in the surface texture of the strip.

According to the invention, an apparatus for carrying out the process comprises at least one strip uncoiler, a stretch-bend leveler or roller leveler downstream from the uncoiling station and a bridle for applying tension to the metal strip.

For strip which has a limited yield point and is relatively sensitive to the formation of Lüders-Lines, the strip is braked upstream of the roller leveler by a dressing stand which is located between the uncoiler and the stretch-bend rolls.

Apart from avoiding the need for coil brakes and L üders-markings, the latter dressing stand imparts a plastic deformation with surface improving characteristics to the strip while generating a brake force which can be in the range of 10–30 metric tons and is satisfactory for the stretch-bend leveling operation. The degree of rolling in the dressing stand should be between 0.5 to 1% to generate this brake force.

It has been found to be advantageous to provide the roller leveler between two dressing stands. Of course the roller leveler can also be disposed between two bridle roller pairs and at any other desired place in the strip line.

The invention also comprises an apparatus for carrying out the method which utilizes at least one strip uncoiling station, a stretch-bend or roller leveler downstream of the strip uncoiling station and having a plurality of stretch-bend rollers, and at least one bridle for applying tension to the metal strip through the stretch-bend leveler. At least one of the stretch-bend rollers at one or both of its ends is pivotal selectively to lengthen the shorter edge of the strip in the manner described. Downstream of the stretch-bend leveler, a measuring device is provided for detecting the horizontal deviation of the longitudinal edges from the liner and control means is connected to the measuring device and has an effector for displacing the at least one swingable stretch-bend roller for dependence upon the detected measured value on one or the other side of the strip.

The measuring device is preferably located 5 meters to 20 meters downstream of the stretch-bend leveler. The measured value is detected continuously and is utilized to supply a continuous correction to the or each of the pivotal stretch-bend rollers to swing the same in the horizontal and/or vertical planes or about respective horizontal or vertical axes and from either of the strip sides. Preferably, the swingable stretch-bend roller is swingable in the horizontal plane and/or the vertical plane about one of its two pivots, depending upon which of the edges of the strip is longer to effect the desired correction.

Preferably the swingable stretch-bend roller is a lower roller of the leveler, i.e. a roller upon which the metal strip lies. However, it is possible in accordance with the invention to utilize as the adjustable, i.e. swingable, stretch-bend roller one or more upper rollers which are pressed to a desired penetration depth into the metal strip path. The term "penetration depth" is here used to indicate the degree to which the strip is pressed out of a median horizontal plane through the leveler.

According to the invention, a plurality of stretch-bend rollers or various stretch-bend rollers of the leveler can be swingably mounted for swinging in the horizontal plane and/or the vertical plane. Advantageously, the swingable stretch-bend rollers have a roll diameter of 40 to 60 times the strip thickness with the roll diameter increasing from the first stretch-bend roller encountered by the strip to the last with the last stretch-bend roller having a diameter which is a maximum of 200 mm.

According to the invention moreover, a servomechanism is provided to effect the pivotal movement of the or each stretch-bend roller which is pivotal and the servomechanism is connected to the control circuit supplied with the measured value and including a computer, e.g. with a microprocessor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
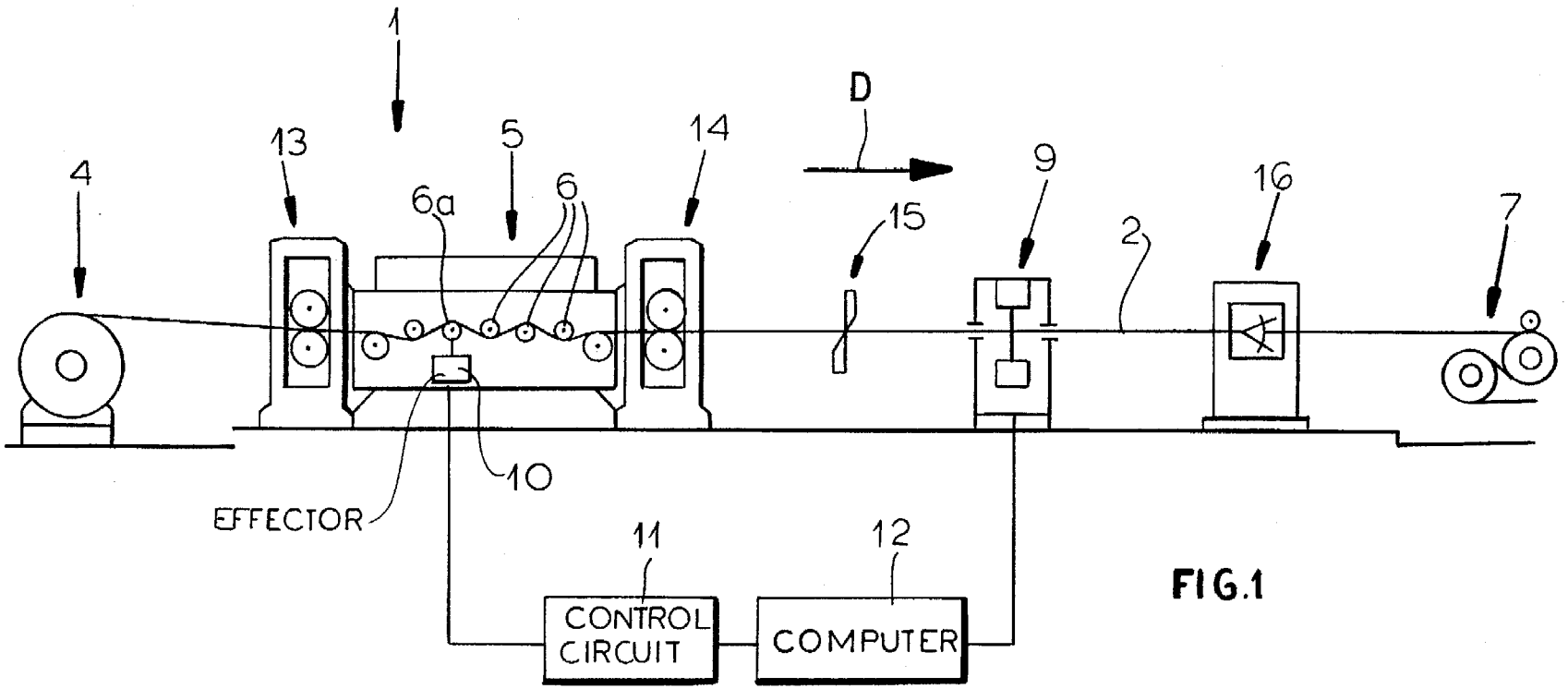
FIG. 1 is a side elevational view of one embodiment of a strip line provided with the system for correcting curvature in the strip plane in the manner described.

FIG. 1 of the drawing shows an apparatus 1 which can form part of a strip processing line and serves for correcting horizontally bent rolled metal strip, i.e. strip which has a bend in the strip plane so that the longitudinal edges of the strip deviate from the linear. The arcs formed by the longitudinal edges 3 of the strip 2 are visible in FIG. 4.

The apparatus comprises at least one strip uncoiling station 4 followed by a stretch-bend leveler 5 or roller leveler with a plurality of stretch-bend rolls 6 over and under which the strip passes under tension. A bridle 7, which can be driven, frictionally entrains the strip and represents the means for generating the tension in the strip which supplies the stretch required for stretch-bend leveling.

At least one of the stretch-bend rollers 6*a* is pivotally mounted at one or both of its roll ends so as to be swingable about a pivot 8 at this end, the pivot end depending upon which of the longitudinal edges of the strip is longer and the pivot having an axis which can be horizontal, or vertical, or a combination of the two.

Downstream of the stretch-bend leveler 5, a measuring device 9 is provided for detecting the effective lengths of the longitudinal edges and thus any deviation from the linear of the horizontal arcs 3 formed thereby. The pivotal stretch-bend roller or rollers 6*a* are provided with effectors represented generally at 10 and forming part of respective servomechanisms to allow these rollers to be pivotally displaced about the pivot axis perpendicular to the roll axis, to an extent dependent upon the measured value of the deviation of the longitudinal edge from the linear, the direction of the pivotal displacement being such as to stretch the shorter side as to equalize the effective lengths of the longitudinal edges of the strip and thereby bring the longitudinal edges into consonance.

The swingable stretch-bend roller 6*a* can thus be swung in a horizontal plane and/or in a vertical plane about a pivot axis at either end, depending upon which of the longitudinal edges is shorter and as is necessary to stretch the shorter side of the strip to a greater extent than the longer side. In FIG. 1, the swingable roller 6a is shown as a lower roller of the stretch-bend leveler. The swingable roller should have a roll diameter of 40 to 60 times the strip thickness.

The effector 10 can be connected to a control circuit 11 operated by the computer 12 in response to the measurement of the longitudinal edges at 9.

As can be seen also in FIG. 1, an upstream dressing stand 13 is provided immediately upstream of the stretch-bend leveler 5 while a downstream dressing stand 14 is provided downstream of the leveler 5. The dressing stand 13 can supply the braking action for the strip necessary to provide the stretching tension in the leveler 5. A shear 15 can be provided to cut out defective portions of the strip and/or to trim the leading and trailing edges of successive lengths of the strip, the excessive lengths being welded together at 16. The strip is displaced in the direction of the arrow D.

Figure 1A:
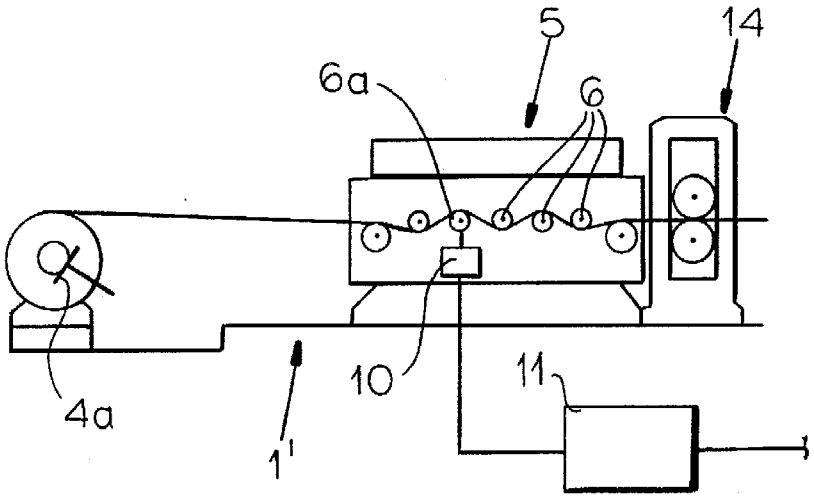
FIG. 1A is a view of a portion of a line similar to that of FIG. 1 but illustrating a modification thereof.
Figure 2:
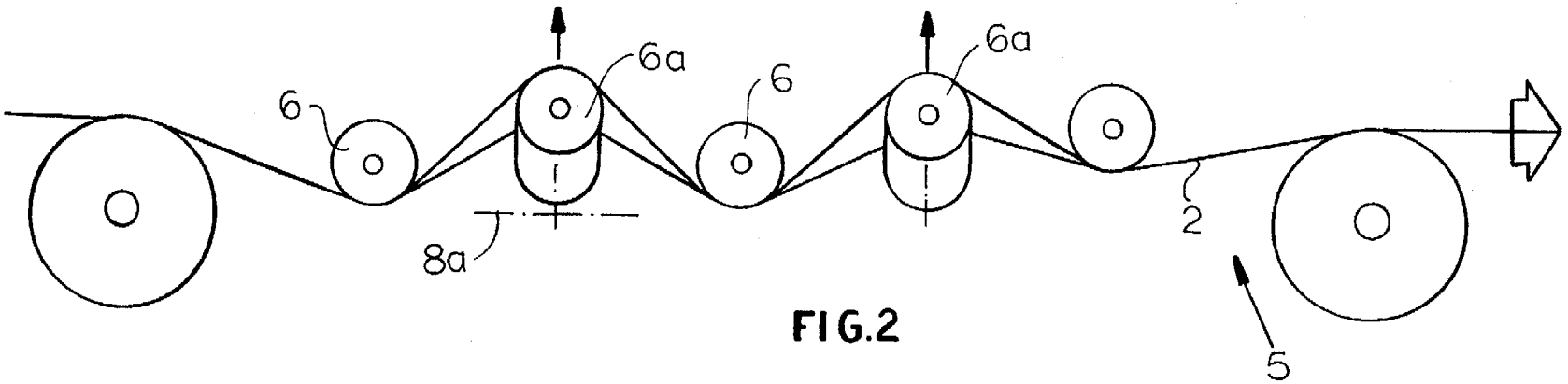
FIG. 2 is a diagrammatic enlarged side elevational view of the leveler showing the pivotal displaceability of the lower rolls about horizontal axes.
Figure 3:
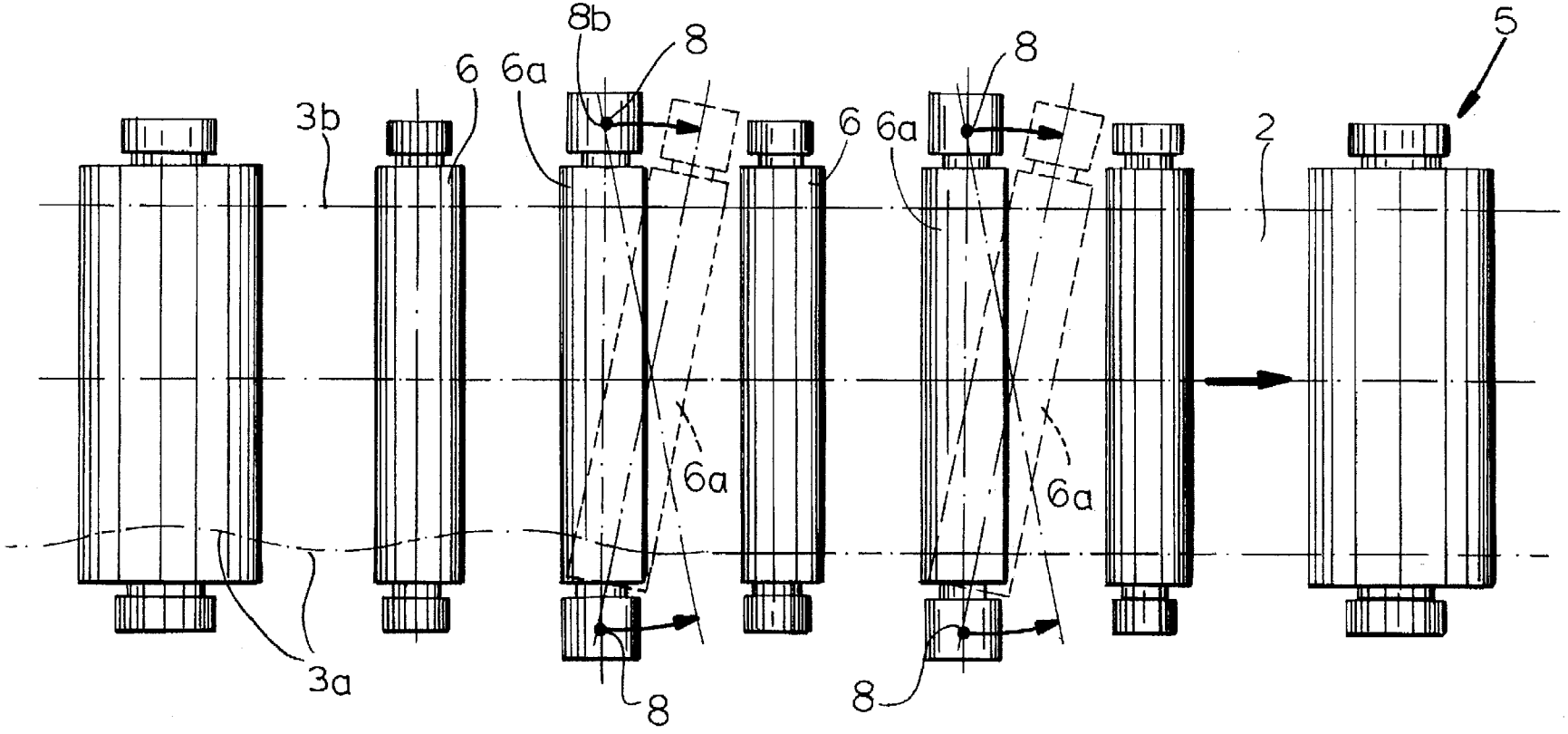
FIG. 3 is a plan view of a roller leveler similar to that of FIG. 1 but showing in broken lines a pivotal displacement of the lower rollers about vertical axes.

In the embodiment of FIG. 1A, the upstream dressing stand 13 is omitted. In this case, the uncoiler 4 may be provided with a brake represented at 4*a*.

The apparatus of the invention operates as follows. If the front end of a bent metal strip 2 having a radius in the strip plane of, say, 2500 mm, reaches the measuring device 9, a deviation of say 5 mm from the linear is indicated, initiating a correction by the horizontal swinging or tilting in the vertical plane of the stretch-bend roller 6*a* or a number of stretch-bend rollers until the deviation is reduced to a value of ±1 mm. The metal strip 2 is then treated as substantially straight.

Figure 4:
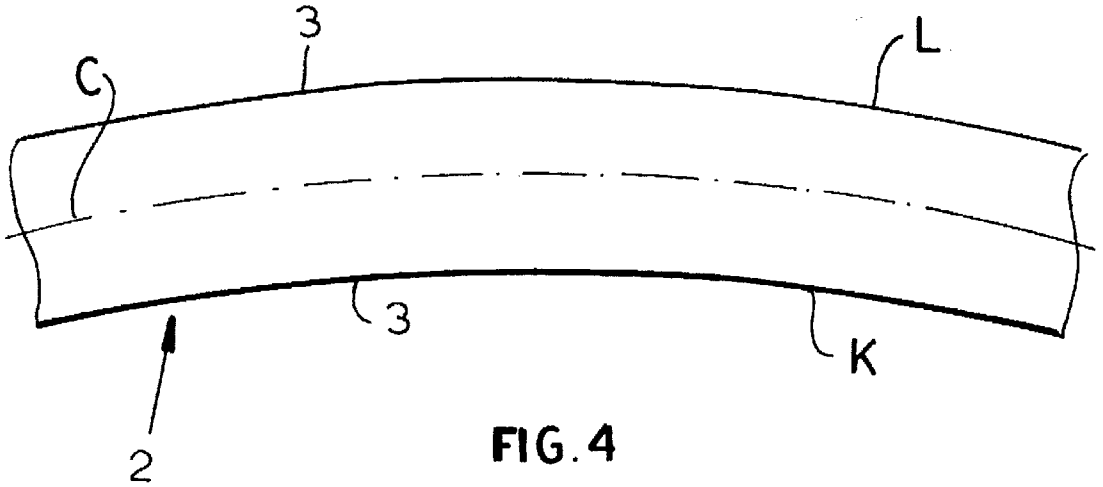
FIG. 4 is a plan view of a tension-free segment of the strip showing, somewhat exaggerated, curvature in the strip plane with a longer strip edge and a shorter strip edge.
Figure 5:
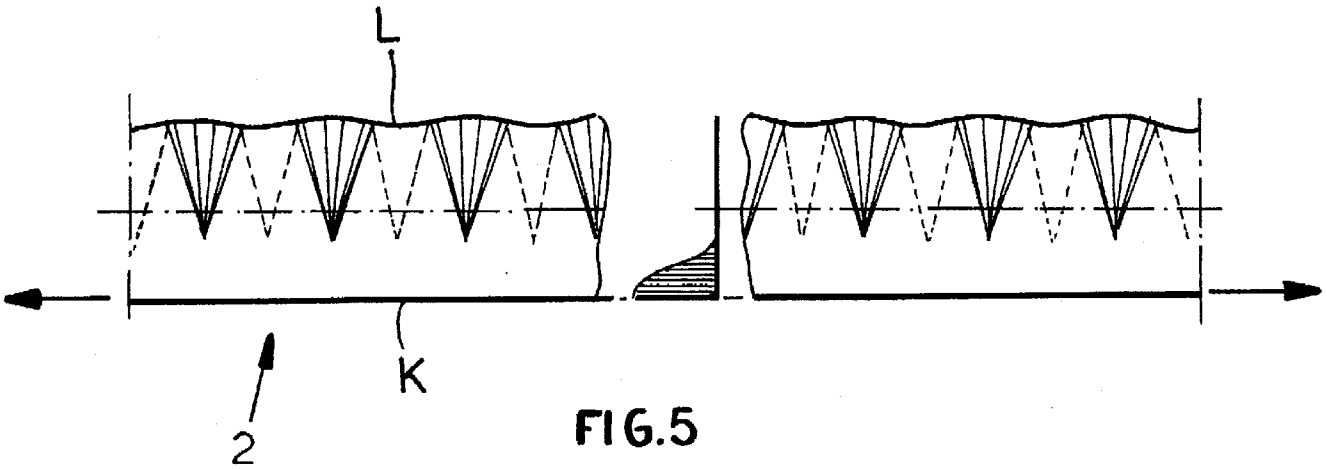
FIG. 5 is a diagram similar to FIG. 4 showing the corrugation formation on the longer strip edge when tension is applied to the strip, the corrugations being exaggerated here as well.
Figure 6:
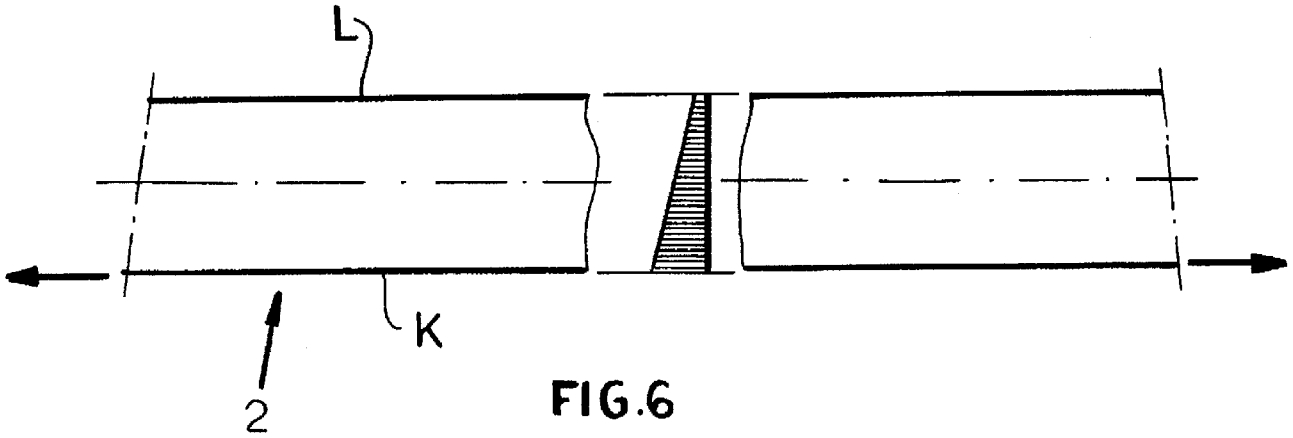
FIG. 6 is an illustration of the strip segment after correction, with the shorter strip side being stretched to a length greater than the longer strip side to counter the tendency of the strip to shrink because of the greater restoring force at this edge.
Figure 7:
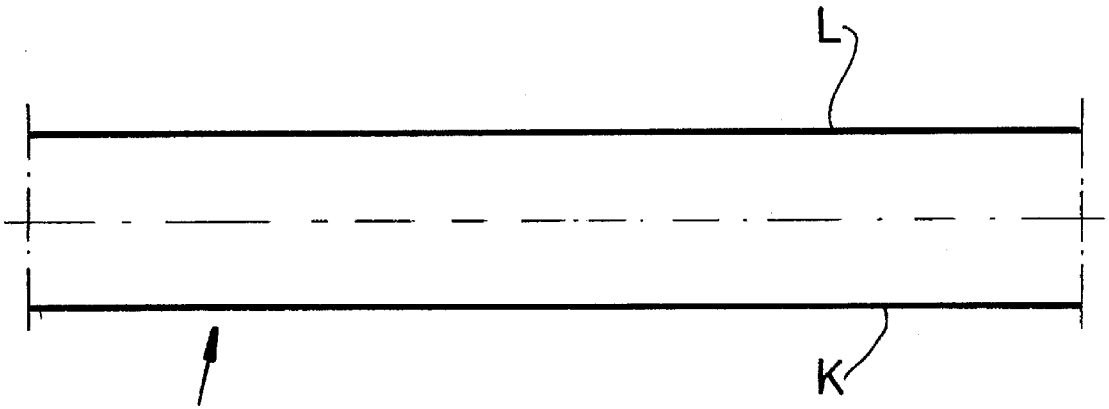
FIG. 7 is an illustration of a strip segment after leveling and in a tension-free state.

The deviation in the region of the front end satisfies the requirements of German Industrial Standard 1016 or the corresponding Euronorm standard. The bending of the strip to linearity corresponds to a wedge-shaped plastic deformation of the strip cross section with the greatest deformation occurring, of course, at the shorter edge K of the strip (FIG. 4). Customarily, the long edge L will also be plastically stretched by 0.3 to 0.5%. The plastic deformation hardens material on the shorter strip side K greater than that on the longer strip side. Because of the different elastic shrinkage of the longer and shorter sides, with greater hardening steels as, for example, with IF steels (interstitial-free steels), the longer strip side L tends to form corrugations (FIG. 5) which can hinder trimming of the edges. For that reason, the shorter side (FIG. 6) is stretched slightly more than is required to equalize the lengths so that after relaxation (FIG. 7) both edges will have equal lengths.

The measuring device 9 is located about 5 meters downstream of the stretch-bending leveler 5. Customarily the arc radius ranges between 1500 and 5000 m. After correction returning the apparatus with the invention, the stretch is straight with a precision which allows laser welding of ends of the strip together via the laser welding device 16.

We claim:

1. A method of correcting curvature of rolled metal strip in a strip plane resulting in deviation of longitudinal edges of the strip from linearity, said method comprising the steps of:

(a) passing a rolled metal strip of a strip thickness of 0.5 mm to 2 mm through a stretch-bend leveler having a plurality of rollers alternately engaging said metal strip from opposite sides thereof;

(b) downstream of said stretch-bend leveler continuously measuring a shape of said longitudinal edges to detect a deviation corresponding to horizontal curving of the strip in the strip plane defined by a shorter edge and an opposed longer edge; and (c) pivoting at least one of said rollers in at least one plane thereof selected from a horizontal plane and a vertical plane in response to said deviation and in relation to said deviation so as to selectively lengthen the shorter edge of said strip to correct said horizontal curving and straighten said strip with coarse correction initially by a pivotal displacement of one of said rollers in said vertical plane and subsequent fine correction by pivotal displacement of one of said rollers in said horizontal plane.

2. The method defined in claim 1 wherein said metal strip is uncoiled prior to stretch-bend leveling, the correction of said horizontal curving being carried out directly after the uncoiling.

3. The method defined in claim 1 wherein said metal strip is uncoiled prior to stretch-bend leveling, said method further comprising the step of dressing said metal strip after the uncoiling thereof, the correction of said horizontal curving being carried out directly after the dressing of the metal strip.

4. A metal strip processing line comprising:

an uncoiler for receiving a coil of rolled metal strip and uncoiling same to pay out the rolled metal strip whereby curvature of the rolled metal strip in a strip plane results in deviation of longitudinal edges of the strip from linearity having a shorter edge and an opposed longer edge;

a stretch-bend leveler downstream from said uncoiler having a plurality of rollers alternately engaging said metal strip from opposite sides thereof, at least one of said rollers having at least one pivot at an end thereof to enable pivotal movement of said one of said rollers in a plane thereof so as to selectively lengthen a shorter edge of the strip;

means spaced downstream from said stretch-bend leveler along a path of said strip for measuring deviation from linearity of longitudinal edges of the strip corresponding to horizontal curving of the strip in the strip plane; and control means responsive to said means for measuring and acting upon said one of said rollers for pivoting said one of said rollers in said plane thereof in response to said deviation and in relation to said deviation to correct said horizontal curving and straighten said strip, a plurality of said rollers are pivotally mounted for movement about respective pivot axes at respective ends thereof in respective vertical and horizontal planes.

5. The strip processing line defined in claim 4 wherein said one of said rollers is a lower roller of said leveler.

6. The strip processing line defined in claim 4 wherein said one of said rollers has a thickness of 40 to 60 times a thickness of said strip.

7. The strip processing line defined in claim 4 wherein said control means includes an effector connected to said one of said rollers for pivoting same and a measurement processing computer connected between said effector and said means for measuring.

8. The strip processing line defined in claim 4, further comprising a dressing stand traversed by said strip and located between said uncoiler and said leveler.

9. The strip processing line defined in claim 4 wherein said leveler is disposed between two dressing stands.

* * * * *